US006427664B1

(12) United States Patent
Boecking

(10) Patent No.: US 6,427,664 B1
(45) Date of Patent: Aug. 6, 2002

(54) PRESSURE BOOSTER FOR A FUEL INJECTION SYSTEM FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/868,046

(22) PCT Filed: Oct. 12, 2000

(86) PCT No.: PCT/DE00/03594

§ 371 (c)(1),
(2), (4) Date: Sep. 27, 2001

(87) PCT Pub. No.: WO01/29396

PCT Pub. Date: Apr. 26, 2001

(30) Foreign Application Priority Data

Oct. 15, 1999 (DE) ..... 199 49 848

(51) Int. Cl.[7] ..... F02M 37/04
(52) U.S. Cl. ..... 123/446; 123/467
(58) Field of Search ..... 123/446, 447, 123/467, 496

(56) References Cited

U.S. PATENT DOCUMENTS 5,622,152 A * 4/1997 Ishida ..... 123/446
5,641,121 A * 6/1997 Beck et al. ..... 239/92
5,852,997 A * 12/1998 Vanderpoel ..... 123/446
5,878,720 A * 3/1999 Anderson et al. ..... 123/496

* cited by examiner

*Primary Examiner*—Thomas N. Moulis
(74) *Attorney, Agent, or Firm*—Ronald E. Greigg

(57) ABSTRACT

An injection system for internal combustion engines with a pressure booster is proposed, in which between injections, a compensation of the hydraulic forces engaging the stepped piston is performed.

30 Claims, 1 Drawing Sheet

PRESSURE BOOSTER FOR A FUEL INJECTION SYSTEM FOR INTERNAL COMBUSTION ENGINES

CROSS-REFERENCE TO RELATED APPLICATIONS

This application is a 35 USC 371 application of PCT/DE 00/03594 filed on Oct. 12, 2000.

BACKGROUND OF THE INVENTION

1. Field of the Invention

The invention relates pressure boosters and particularly to a pressure booster for a fuel injection system for internal combustion engines.

2. Description of the Prior Art

As exhaust gas standards become increasingly stringent, ever-higher injection pressures are required to improve mixture formation and combustion. The result is greater mechanical and thermal stresses on the fuel injection system. Furthermore, the demand for driving power is increasing disproportionately, since with the pressure, the losses in the fuel injection system rise as well.

OBJECTS AND SUMMARY OF THE INVENTION

The object of the invention is to furnish a fuel injection system in which the hydraulic forces acting on the pressure booster are reduced, and in which the pressure booster is simple to control. In addition, higher injection pressures should be made possible and at the same time the stress and the demand for driving power on the injection pump should be reduced.

This object is attained according to the invention by a pressure booster for a fuel injection system for internal combustion engines, having an injection nozzle and having an injection pump that has a high-pressure part, the high-pressure part of the injection pump being in operative communication with the injection nozzle via a control line communicating with the low-pressure side of the pressure booster and via a high-pressure path communicating with the high-pressure side of the pressure booster, characterized in that means to compensate for the hydraulic force acting on the low-pressure side of the pressure booster between injections are present.

This pressure booster has the advantage that between injections, the pressure forces acting on the stepped piston are reduced, so that after the end of the injection, the stepped piston can be returned with less force to its outset position toward the pump, and the pressure booster can be controlled in a simple way. The leakage and throttling losses of the fuel injection system are reduced as well, which leads to a reduction in the demand for driving power and improves the hydraulic efficiency of the fuel injection system. In addition, the high injection pressures allow smaller injection port diameters for the injection nozzle, which improves the mixture formation at all operating points.

In a feature of the pressure booster of the invention, it is provided that the pressure booster has a stepped piston, which is displaceable in a bore and whose end faces each define one pressure chamber; that a first, larger end face of the stepped piston defines a first pressure chamber, communicating with the control line; that a second, opposed, smaller end face of the stepped piston defines a second pressure chamber, communicating with the high-pressure path; that an annular face opposite the first end face defines a control chamber; and that between injections, the pressure is the same in both the first pressure chamber and the control chamber. This version has the advantage that despite a simple design, it has the advantages of the invention.

In a further feature of the invention, it is provided that the first end face and the annular face are essentially the same size, so that the hydraulic forces on the stepped piston are compensated for entirely between injections.

Another embodiment provides that the control chamber communicates hydraulically with the first pressure chamber via an inlet throttle, so that during the injection, pressure equalization between the first pressure chamber and the control chamber is prevented.

In one feature of the invention, the control chamber can be pressure-relieved via a control valve, in particular a 2/21-way control valve, so that the onset of supply by the pressure booster is controllable by opening the control valve.

A further variant provides that a restoring spring is fastened in the first pressure chamber and is braced on a support and a shoulder of the stepped piston and as a function of the pressure in the first pressure chamber and the pressure in the control chamber presses the stepped piston, between injections, against its stop toward the pump, so that after the end of injection, the stepped piston is put into its outset position regardless of the pressures that prevail. Furthermore, the restoring spring requires only little installation space.

In a feature of the invention, the shoulder is separably connected to the stepped piston, thus simplifying production and assembly.

In a further feature of the invention, the fuel flows out of the first pressure chamber into a leaking oil return via an outlet throttle, so that the pressure level in the leaking oil return is created indirectly by the injection pump.

A further variant of the invention provides that the second pressure chamber is filled from the leaking oil return, and that a check valve, which blocks the return flow of fuel from the second pressure chamber to the leaking oil return, is disposed between the second pressure chamber and the leaking oil return, so that the filling is simple, and only a low pressure prevails in the second pressure chamber between injections.

Further in the invention, it is provided that the pressure in the leaking oil return is less than the opening pressure of the injection nozzle, so that the injection nozzle closes securely between injections.

In one feature of the invention, to simplify production and assembly, the stepped piston is embodied in two parts.

One version of the invention provides that the control quantity of the control valve is carried away into the leaking oil return, so that a simple hydraulic circuit is attained.

In another variant, it is provided that the control piston is guided in a sleeve, so that the guidance of the stepped piston is improved.

BRIEF DESCRIPTION OF THE DRAWINGS

Further features and advantages of the invention can be learned from the ensuing description, taken with the drawings, in which.

DESCRIPTION OF THE PREFERRED EMBODIMENTS

Figure 1:
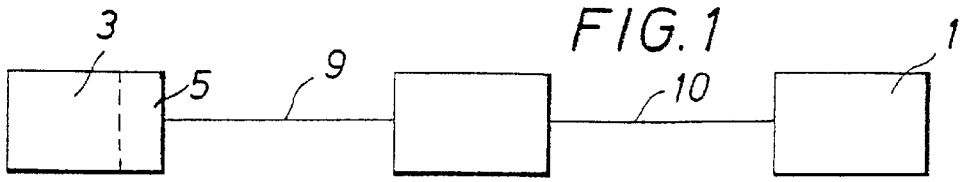
FIG. 1: a schematic illustration of a fuel injection system of the invention.

FIG. 1 schematically shows a fuel injection system with an injection nozzle 1 and an injection pump 3, which has a high-pressure part 5. The high-pressure part 5 communicates operatively with the injection nozzle 1 via a control line 9 and a high-pressure path 10. A pressure booster is disposed between the control line 9 and the high-pressure path 10.

Figure 2:
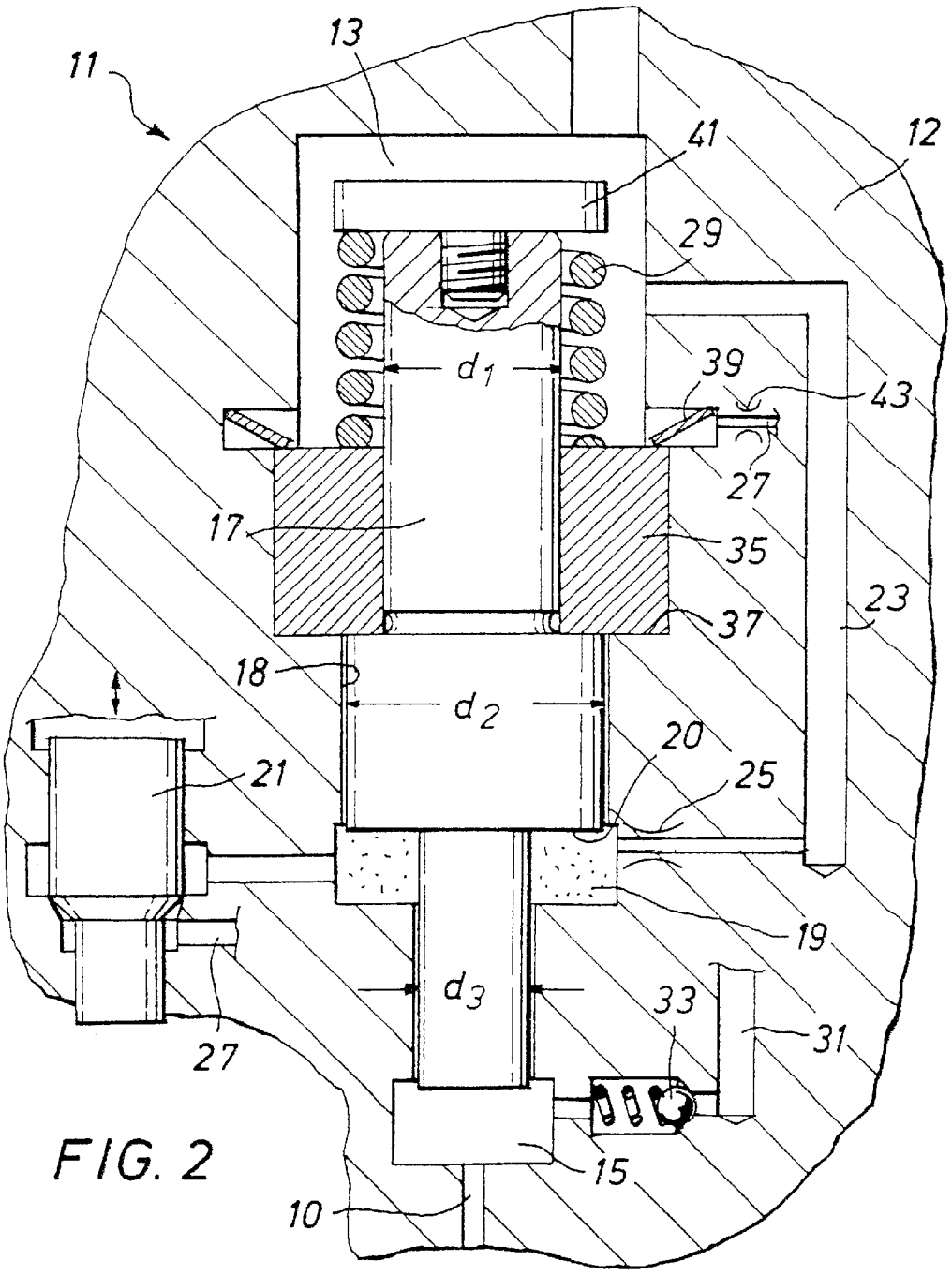
FIG. 2: an illustration of a pressure booster of the invention.

In FIG. 2, a pressure booster 11 of the invention is shown. In a housing 12, the pressure booster 11 has a first pressure chamber 13, a second pressure chamber 15, a one-part or multi-part stepped piston 17 that is guided in a bore 18, and a control chamber 19.

The first pressure chamber 13 and the end face of the stepped piston 17 that protrudes into the first pressure chamber 13, which end face has the diameter $d_1$, form the low-pressure side of the pressure booster 11. The second pressure chamber 15 and the end face, having the diameter $d_3$, of the stepped piston 17 protruding into the second pressure chamber 15 form the high-pressure side of the pressure booster 11.

The control chamber 19 is defined in the longitudinal direction by an annular face 20 of the stepped piston 17 and a shoulder in the housing 12 of the pressure booster 11.

Between injections, a 2/2-way control valve 21 communicating with the control chamber 19 is closed. The first pressure chamber 13 and the control chamber 19 communicate through a connecting line 23, which has an inlet throttle 25, so that when the control valve 21 is closed, the same pressure prevails in both chambers 13 and 19. Via the end face, protruding into the first pressure chamber 13, of the stepped piston 17 and the annular face 20, a compensation of the hydraulic forces takes place. The compensation is complete when the condition $$\frac{d_1^2}{4} = \frac{d_2^2 - d_3^2}{4}$$

is met. A slight overcompensation of the hydraulic force acting on the end face of the stepped piston 17 can be advantageous.

The invention is tripped by opening the control valve 21. The fuel located in the control chamber 19 flows through the control valve 21 into a leaking oil return 27. The inlet throttle 25 causes the pressure in the control chamber 19, when the control valve 21 is opened, to drop below the pressure in the first pressure chamber 13. As a consequence, there is no longer a force compensation between the end face of the stepped piston 17 protruding into the first pressure chamber 13 and the annular face 20. The stepped piston 17 begins to pump.

By means of the ratio between the end faces protruding into the first pressure chamber 13 and into the second pressure chamber 15, the ratio of the pressures in the first and second pressure chambers 13 and 15 is specified. As soon as the pressure in the second pressure chamber 15 or in the high-pressure path 10 exceeds the opening pressure of the injection nozzle 1, the injection nozzle 1 opens and the injection begins.

As soon as the control valve 21 is closed again, a pressure equalization and force compensation takes place between the first pressure chamber 13 and the control chamber 19, so that the stepped piston 17 is moved into the position shown in FIG. 2, in the direction of the first pressure chamber 13, by a restoring spring 29. As soon as the stepped piston 17 moves in the direction of the first pressure chamber 13, the pressure in the second pressure chamber 15 collapses, and the injection nozzle 1 closes.

The second pressure chamber 15 is filled via a supply line 31 subjected to leaking oil pressure. A check valve 33 is disposed in this supply line 31. The check valve 33 can be spring-loaded, as seen in FIG. 2, or can be embodied without a spring, and it prevents the return flow of fuel during injection. The leaking oil pressure is below the opening pressure of the injection nozzle 1.

The stepped piston 17 is guided with its diameter $d_1$ by a sleeve 35. The sleeve 35 is radially fixed in the housing 12. In the axial direction, a shoulder 37 of the housing 12 and a cup spring 39 assure the fixation of the sleeve 35. The housing 12 can be split along the shoulder 37, to make production and assembly of the pressure booster 11 of the invention easier. The cup spring 39 prevents the stepped piston 17 from a "hard" landing on its stop toward the pump.

The restoring spring 29 is fastened between the sleeve 35 and a shoulder 41 of the stepped piston 17. FIG. 2 shows an embodiment in which the shoulder 41 is screwed into the stepped piston 17. However, still other embodiments are also conceivable.

Via an outlet throttle 43, fuel flows out of the first pressure chamber 13 into the leaking oil return. Via the outlet throttle 43, the pressure level in the leaking oil return can be varied.

The foregoing relates to preferred exemplary embodiments of the invention, it being understood that other variants and embodiments thereof are possible within the spirit and scope of the invention, the latter being defined by the appended claims.

What is claimed is:

1. A pressure booster for a fuel injection system for internal combustion engines, comprising an injection nozzle (1), an injection pump (3) having a low pressure side and a high-pressure part (5), the high-pressure part (5) of the injection pump (3) being in operative communication with the injection nozzle (1) via a control line (9) communicating with the low-pressure side of the pressure booster (11) and via a high-pressure path (10) communicating with the high-pressure side of the pressure booster (11), and means (20) for compensation for the hydraulic force acting on the low-pressure side of the pressure booster (11) between injections.

2. The pressure booster of claim 1, wherein the pressure booster (11) has a stepped piston (17), which is displaceable in a bore (18) and whose end faces each define one pressure chamber; that a first, larger end face of the stepped piston (17) defines a first pressure chamber (13), communicating with the control line (9); that a second, opposed, smaller end face of the stepped piston (17) defines a second pressure chamber (15), communicating with the high-pressure path (10); that an annular face (20) opposite the first end face defines a control chamber (19); and that between injections, the pressure is the same in both the first pressure chamber (13) and the control chamber (19).

3. The pressure booster of claim 2, wherein the first end face and the annular face (20) are essentially the same size.

4. The pressure booster of claim 2, wherein the control chamber (19) communicates hydraulically with the first pressure chamber (13) via an inlet throttle (25).

5. The pressure booster of claim 2, wherein the control chamber (19) can be pressure-relieved via a control valve (21), in particular a 2/2-way control valve (21).

6. The pressure booster of claim 2, wherein a restoring spring (29) is fastened in the first pressure chamber (13) and is braced on a support (35) and a shoulder (41) of the stepped piston (17) and as a function of the pressure in the first pressure chamber (13) and the pressure in the control chamber (19) presses the stepped piston (17), between injections, against its stop toward the pump.

7. The pressure booster of claim 6, wherein the shoulder (41) is separably connected to the stepped piston (17).

8. The pressure booster of claim 2, wherein fuel flows out of the first pressure chamber (13) into a leaking oil return (27) via an outlet throttle (43).

9. The pressure booster of claim 2, wherein the second pressure chamber (15) is filled from a leaking oil return (27), and that a check valve (33), which blocks the return flow of fuel from the second pressure chamber (15) to the leaking oil return (27), is disposed between the second pressure chamber (15) and the leaking oil return (27).

10. The pressure booster of claim 9, wherein the pressure in the leaking oil return (27) is less than the opening pressure of the injection nozzle (1).

11. The pressure booster of claim 1, wherein the stepped piston (17) is embodied in two parts.

12. The pressure booster of claim 5, wherein, when the control valve (21) is open, a quantity of fuel is carried away from the control chamber (19) into a leaking oil return (27).

13. The pressure booster of claim 2, wherein the stepped piston (17) is guided in a sleeve (35).

14. The pressure booster of claim 3, wherein the control chamber (19) communicates hydraulically with the first pressure chamber (13) via an inlet throttle (25).

15. The pressure booster of claim 3, wherein the control chamber (19) can be pressure-relieved via a control valve (21), in particular a 2/2-way control valve (21).

16. The pressure booster of claim 4, wherein the control chamber (19) can be pressure-relieved via a control valve (21), in particular a 2/2-way control valve (21).

17. The pressure booster of claim 3, wherein a restoring spring (29) is fastened in the first pressure chamber (13) and is braced on a support (35) and a shoulder (41) of the stepped piston (17) and as a function of the pressure in the first pressure chamber (13) and the pressure in the control chamber (19) presses the stepped piston (17), between injections, against its stop toward the pump.

18. The pressure booster of claim 14, wherein a restoring spring (29) is fastened in the first pressure chamber (13) and is braced on a support (35) and a shoulder (41) of the stepped piston (17) and as a function of the pressure in the first pressure chamber (13) and the pressure in the control chamber (19) presses the stepped piston (17), between injections, against its stop toward the pump.

19. The pressure booster of claim 16, wherein a restoring spring (29) is fastened in the first pressure chamber (13) and is braced on a support (35) and a shoulder (41) of the stepped piston (17) and as a function of the pressure in the first pressure chamber (13) and the pressure in the control chamber (19) presses the stepped piston (17), between injections, against its stop toward the pump.

20. The pressure booster of claim 3, wherein fuel flows out of the first pressure chamber (13) into a leaking oil return (27) via an outlet throttle (43).

21. The pressure booster of claim 4, wherein fuel flows out of the first pressure chamber (13) into a leaking oil return (27) via an outlet throttle (43).

22. The pressure booster of claim 14, wherein fuel flows out of the first pressure chamber (13) into a leaking oil return (27) via an outlet throttle (43).

23. The pressure booster of claim 16, wherein fuel flows out of the first pressure chamber (13) into a leaking oil return (27) via an outlet throttle (43).

24. The pressure booster of claim 3, wherein the second pressure chamber (15) is filled from the leaking oil return (27), and that a check valve (33), which blocks the return flow of fuel from the second pressure chamber (15) to the leaking oil return (27), is disposed between the second pressure chamber (15) and the leaking oil return (27).

25. The pressure booster of claim 6, wherein the second pressure chamber (15) is filled from the leaking oil return (27), and that a check valve (33), which blocks the return flow of fuel from the second pressure chamber (15) to the leaking oil return (27), is disposed between the second pressure chamber (15) and the leaking oil return (27).

26. The pressure booster of claim 23, wherein the second pressure chamber (15) is filled from the leaking oil return (27), and that a check valve (33), which blocks the return flow of fuel from the second pressure chamber (15) to the leaking oil return (27), is disposed between the second pressure chamber (15) and the leaking oil return (27).

27. The pressure booster of claim 2, wherein the stepped piston (17) is embodied in two parts.

28. The pressure booster of claim 3, wherein the stepped piston (17) is embodied in two parts.

29. The pressure booster of claim 15, wherein, when the control valve (21) is open, a quantity of fuel is carried away from the control chamber (19) into a leaking oil return (27).

30. The pressure booster of claim 16, wherein, when the control valve (21) is open, a quantity of fuel is carried away from the control chamber (19) into a leaking oil return (27).

* * * * *